United States Patent [19]

DeLuca

[11] Patent Number: 4,777,408

[45] Date of Patent: Oct. 11, 1988

[54] ELECTRONIC ADORNMENT FOR SIMULATING NATURAL FLICKERING LIGHT

[76] Inventor: Frederick P. DeLuca, 3520 Jewel Dr., Ames, Iowa 50010

[21] Appl. No.: 877,333

[22] Filed: Jun. 23, 1986

[51] Int. Cl.[4] ..... H05B 37/02

[52] U.S. Cl. ..... 315/158; 315/307; 362/104; 362/806

[58] Field of Search ..... 368/83, 201; 362/103, 362/104, 800, 806; 340/33; 315/158

[56] References Cited

U.S. PATENT DOCUMENTS

| | | | |
|---|---|---|---|
| 3,521,041 | 7/1970 | Van Blerkom et al. | 364/724 |
| 3,540,207 | 11/1970 | Keeler | 368/201 |
| 3,737,647 | 6/1973 | Gomi | 362/104 |
| 3,747,323 | 7/1973 | Eckenrode | 368/83 |
| 3,866,035 | 2/1975 | Richey, Jr. | 362/104 |
| 3,901,121 | 8/1975 | Kleiner | 362/104 |
| 4,095,139 | 6/1978 | Symonds et al. | 315/158 |
| 4,161,018 | 7/1979 | Briggs et al. | 362/104 |
| 4,170,036 | 10/1979 | Sussel | 362/104 |
| 4,254,451 | 3/1981 | Cochran, Jr. | 362/103 |
| 4,264,845 | 4/1981 | Bednarz | 315/323 |
| 4,296,459 | 10/1981 | De Luca | 362/800 |
| 4,605,882 | 8/1986 | De Luca | 315/307 |

FOREIGN PATENT DOCUMENTS 2261663 9/1975 France .

*Primary Examiner*—David K. Moore
*Assistant Examiner*—Theodore Salindong
*Attorney, Agent, or Firm*—Zarley, McKee, Thomte, Voorhees & Sease

[57] ABSTRACT

An electronic adornment for clothing, jewelry and the like includes an electrically operated light emitter and an electrical circuit operative to intermittently actuate the light emitter to closely simulate natural flickering light from faceted gemstones. The electrical circuit includes independent controls for pulse frequency and pulse width.

13 Claims, 4 Drawing Sheets

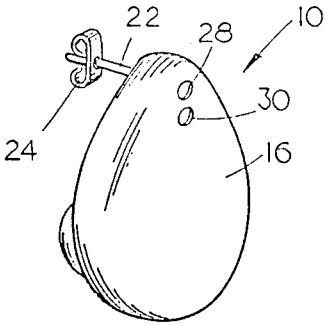
FIG. 1
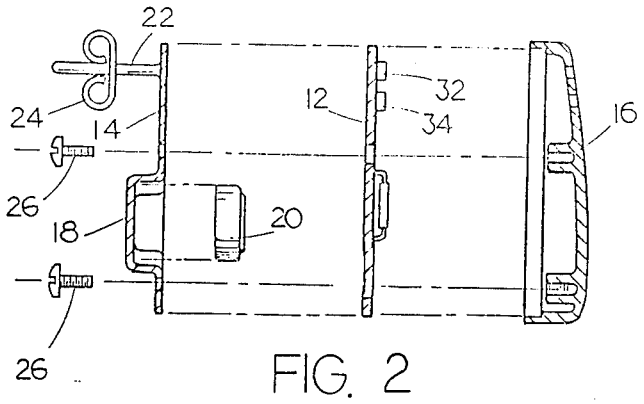
FIG. 2
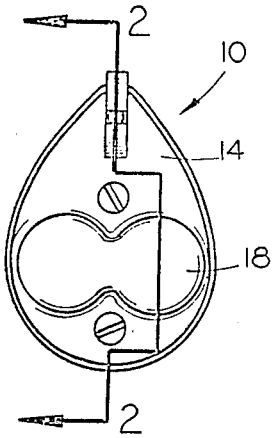
FIG. 3
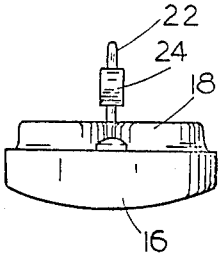
FIG. 4
FIG. 5
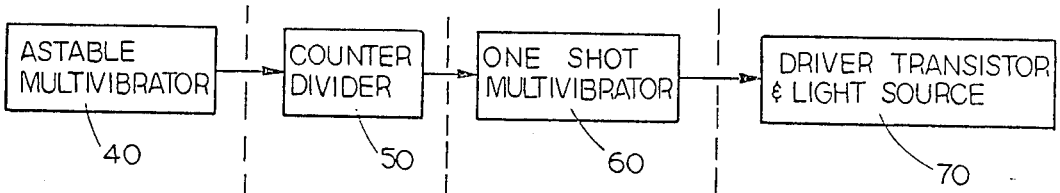
FIG. 6
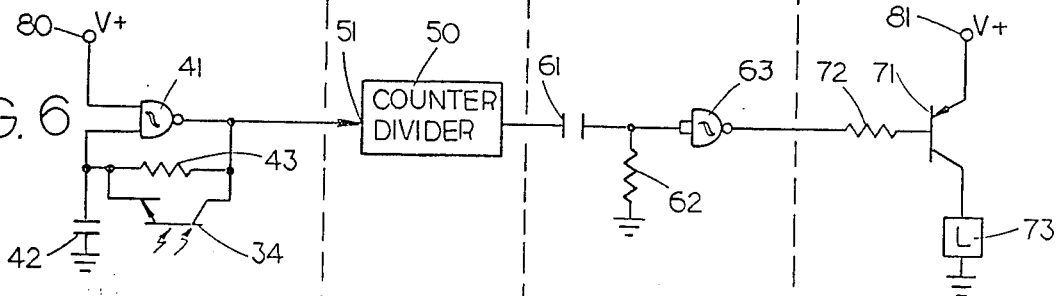
FIG. 7
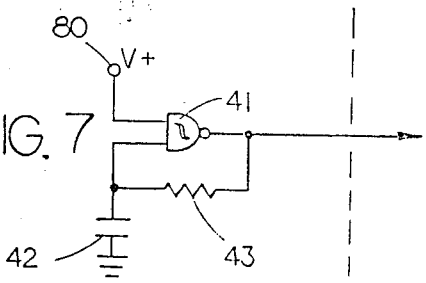
FIG. 8
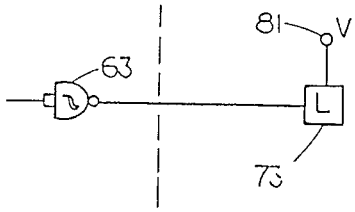

ELECTRONIC ADORNMENT FOR SIMULATING NATURAL FLICKERING LIGHT

BACKGROUND OF THE INVENTION

The present invention is directed generally to light-emitting electronic adornments and more specifically to articles of personal adornment such as jewelry and clothing including electronic circuitry for simulating the natural flickering of light from faceted gemstones.

Electronic light-emitting jewelry has previously been known. See for example this inventor's own prior U.S. Pat. No. 4,296,459 and his U.S. Pat. No. 4,605,882 and the references cited therein. Some forms of electronic jewelry utilize an oscillator or multivibrator for timing the flashing of one or more light sources in a fixed sequence. Examples of these can be found in U.S. Pat. Nos. 3,521,041; 3,866,035; 3,901,121; and 4,170,036. Other devices include means for varying the frequency of the oscillator or multivibrator and/or to change the sequence of flashing lights as in U.S. Pat. Nos. 3,737,647; 4,161,018; 4,264,845 and 4,254,451.

The devices of all of the above references suffer from lack of independent control or very limited control of both pulse width and pulse rate. The problem is that when the pulse width is decreased, the pulse rate increases and vice versa.

Lack of independent control of pulse width and pulse rate leads to several problems. One problem is related to the visual effect. A short pulse width is desired because it produces a quick short flash of light. But to obtain a short pulse width, the pulse rate must be increased. The result is a pulse rate that is too high for good visual effect. For example, even a compromise between pulse width and pulse rate results in too high a pulse rate, generally between one and ten pulses per second. With only one or just a few lights, this pulse rate appears monotonous. With many lights, the visual effect improves but the high amount of visual stimuli is unlike a natural piece of jewelry which produces occasional flickers and random bursts of light.

Another problem is the high current drain required by the high pulse rates. The duty cycle for a square wave is 50% but if two or more lights are used and light is continuously emitted, the effective duty cycle is 100%. Larger batteries are necessary to avoid frequent replacement and this undesirably increases the physical size and weight of the jewelry.

Accordingly, a primary object of the present invention is to provide light-emitting electronic adornments which are operative to more closely simulate natural flickering light.

A related object is to provide light-emitting electronic adornments with improved visual effects and reduced current drain.

Another object is to provide such adornments with independent control of pulse width and pulse rate.

Another object is to provide such adornments with the capability to reduce the pulse width and pulse rate, and thereby reduce the duty cycle to less than 0.04 percent.

Another object is to provide such adornments with a simple means for pulsing one or more light sources at random intervals.

Another object is to provide articles of electronic jewelry that are small in physical size and weight.

Finally, another object is to provide such adornments which closely simulate the random flickering of polished surfaces and faceted gemstones.

SUMMARY OF THE INVENTION

The electronic adornment for clothing, jewelry and the like, according to the present invention, includes a base item of personal adornment adapted to be worn by a person, an electrically operated light emitter, and an electrical circuit operative to intermittently actuate the light emitter to produce occasional flickers and random bursts of light to closely simulate natural flickering light from faceted gemstones.

The electrical circuit includes an output frequency control and a pulse width control which operate independent of one another so that a desired output can be achieved without compromise between optimum pulse width and optimum frequency. The circuit optionally includes means for randomly varying both the frequency and pulse width of the signals which actuate the light emitter. Furthermore, groupings of light emitters may be provided for actuation at random time intervals width occasional rapid sequential pulsing to give the appearance of an occasional flicker of light followed by a rapid burst of several lights in sequence.

In a preferred embodiment, frequency control is achieved by an astable multivibrator in combination with a counter/divider. Pulse width control is achieved by a one-shot multivibrator which acts upon the output of the counter/divider. The output of the one-shot multivibrator may be connected to a light emitter directly or indirectly through a driver transistor. In the alternative, where multiple light emitters are included, the output of the one-shot multivibrator may be directed to a Johnson Counter, the output of which is directed through a plurality of gates to the respective light emitters.

BRIEF DESCRIPTION OF THE DRAWINGS

FIG. 1 is a perspective view of a light-emitting electronic earring;

FIG. 2 is an exploded side sectional view of the earring of FIG. 1;

FIG. 3 is a rear elevational view of the earring of FIG. 1;

FIG. 4 is a bottom view of the earring of FIG. 1;

FIG. 5 is a functional block diagram of a basic circuit for the invention;

FIG. 6 is an electrical schematic diagram for the circuit of FIG. 5;

FIG. 7 is a detail electrical schematic diagram of an alternate multivibrator for the circuit of FIG. 6;

FIG. 8 is a detail electrical schematic diagram of an alternate connection of the light emitter in the circuit of FIG. 6;

DESCRIPTION OF THE PREFERRED EMBODIMENTS

Figures 9, 10, 11:
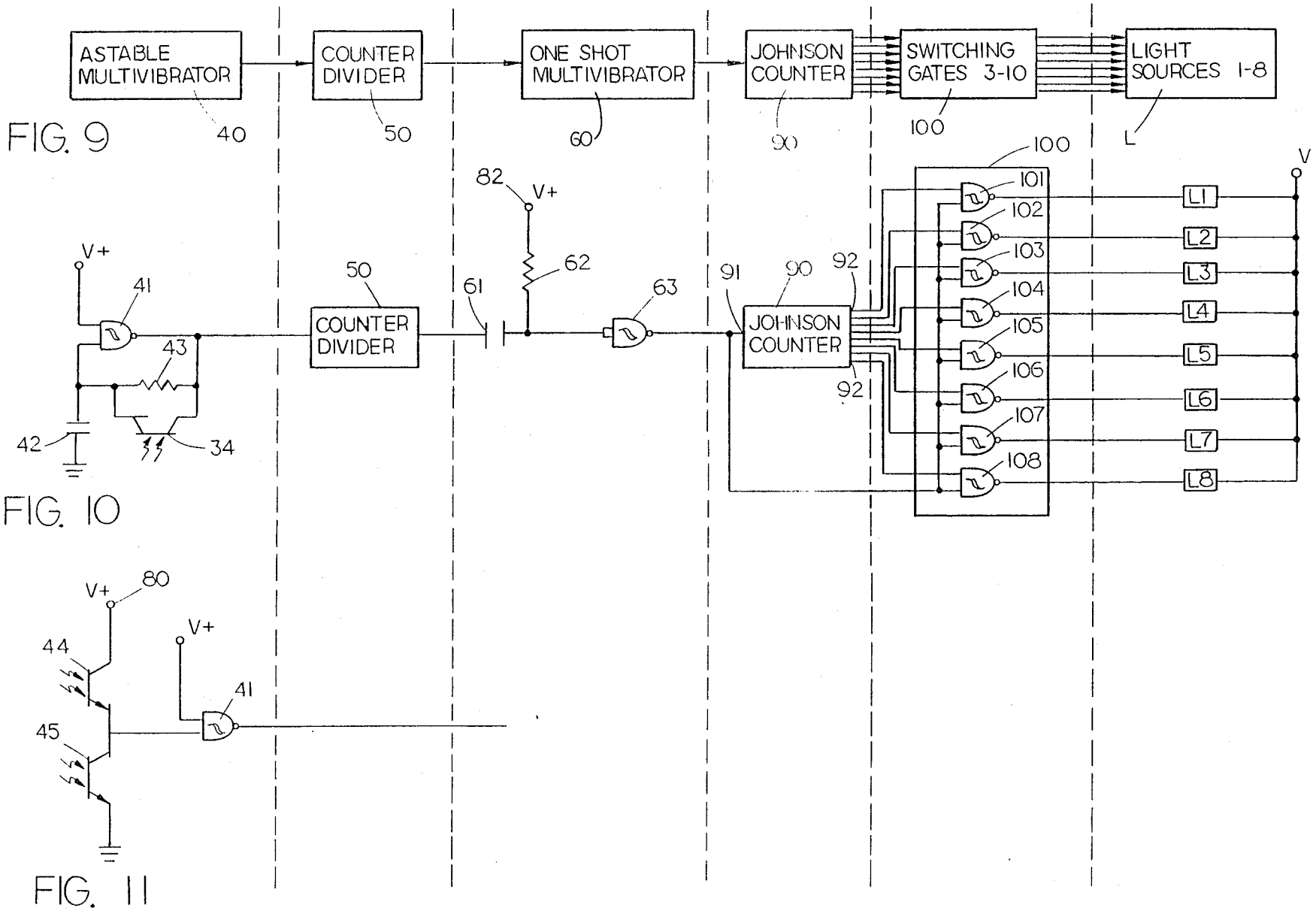
FIG. 9 is a functional block diagram of another circuit of the invention.
FIG. 10 is an electrical schematic diagram of the circuit of FIG. 9.
FIG. 11 is a detail electrical schematic diagram of an alternate source of random frequency pulses for the circuit of FIG. 10.

The light-emitting electronic adornment of the present invention is illustrated in FIGS. 1–4 as embodied within an earring 10. The earring is for illustrative purposes only as it should be understood that the improved light-emitting adornment of the invention may be applied to all types of personal items including jewelry and clothing. As seen in FIG. 2, the earring 10, or base item of jewelry, includes a printed circuit board 12 sandwiched between a back piece 14 and a front cover 16. Back piece 14 includes a recess 18 for carrying the batteries 20 which power the circuit of the device. Back piece 14 is also provided with a conventional post 22, clasp 24 and screws 26 for securing the parts together.

The front cover 16 includes two apertures 28 and 30 which are positioned for registration, respectively, with a light emitter 32, such as a light-emitting diode, and a light sensor such as phototransistor 34 on the printed circuit board 12. Additional apertures may be provided to accommodate any additional light sensors included in the circuit.

The operation of the earring is described below in connection with the circuit description. This circuit is applicable to all types of jewelry including, but not limited to, earrings, pendants, pins, bracelets, rings, charms, belt buckles, button caps, cuff links, and barrettes. The housing shown in FIGS. 1–4 could be used as an earring, necklace, pin or charm depending on the type of fastener used. The batteries could alternately be positioned in other jewelry wherein clearance from the ear is not a design criteria.

One embodiment of the circuit of the invention is illustrated in basic block form in FIG. 5 sn including an astable multivibrator from which an output signal of randomly pulsed frequency is sent to a counter/divider 50 which coacts with the astable multivibrator to send pulses of randomly changing frequency to a one-shot multivibrator 60 which produces a shortened pulse output for actuating a driver transistor and light source 70 to produce an elegant random flickering light.

A schematic electrical diagram is shown in FIG. 6. The individual circuit elements are described as follows.

The astable multivibrator 40 includes gate 41, capacitor 42, resistor 43 and phototransistor 34. Phototransistor 34 acts to increase the output frequency of the multivibrator in bright light and reduce the frequency in dim light. The frequency of the multivibrator changes randomly as the wearer of the jewelry moves because the light intensity is usually different in different directions.

The output of the astable multivibrator 40 is connected to the "count" input 51 of the counter/divider which may be provided as a 74HC4020 integrated circuit. The division factor of the counter/divider 50, in conjunction with the values of capacitor 42, resistor 43 and phototransistor 34, produces random pulses which range from about one every fifteen seconds to one pulse every two minutes, depending on the light intensity on phototransistor 34.

The output of the counter/divider is applied to capacitor 61 which coacts with resistor 62 and gate 63 to form the one-shot multivibrator 60. When the output of the counter/divider 50 goes high, the output of the one-shot multivibrator 60 goes low for a short time. The pulse width from the one-shot multivibrator 60 is set at about six milliseconds by the values of capacitor 61 and resistor 62.

The output of the one-shot multivibrator 60 is connected to switching transistor 71 by way of the current limiting resistor 72. When the base of transistor 71 goes low, light emitter 73 will emit a six millisecond flick of light. The result is a rather elegant, random flickering light. Voltage sources 80 and 81 are connected into the circuit as shown.

Typical values for the various circuit elements in one example of the circuit of FIG. 6 are as follows: capacitor 42, 0.01 microfarads; resistor 43, 2.2 meg. ohms (2,200,000 ohms); capacitor 61, 0.01 microfarads; resistor 62, 825 K ohms (825,000 ohms) and resistor 72, 1 K ohm (1,000 ohms).

The embodiment of FIG. 6 may be modified by eliminating the phototransistor 34, as illustrated in FIG. 7, so the multivibrator operates at a fixed frequency.

Another alternative is to omit the current limiting resistor 72 and switching transistor 71, and drive the light emitter 73 directly from gate 63 as indicated in FIG. 8. A third alternative is to combine the alternatives of FIGS. 7 and 8 in the circuit of FIG. 6.

Another embodiment of the invention is illustrated in FIGS. 9 and 10. The first three stages, including astable multivibrator 40, counter/divider 50 and one-shot multivibrator 60, are the same as those in the embodiment of FIGS. 5 and 6 except that resistor 62 of one-shot multivibrator 60 is tied to a positive voltage source 82 to reverse the polarity of the output of the one-shot multivibrator. When the output of the counter/divider 50 goes low, the output of the one-shot multivibrator will go high. The positive pulse from the one-shot multivibrator 60 is applied to the "clock" input 91 of a Johnson Counter 90 and to the "enable" input of all the switching gates 101–108. Each one of the eight outputs 92 from the Johnson Counter 90 are connected to an input of gates 101–108, as shown in FIG. 10. Each positive pulse at the input of the Johnson Counter 90 advances the output by one, applies a positive voltage to one of the eight switching gates 101–108 and activates one of the eight light emitters L1–L8. A light emitter is activated for about six milliseconds because that is the width of the enabling pulse as set by the values of capacitor 61 and resistor 62. The result is that each of the eight light emitters L1–L8 will be pulsed in a fixed sequence but at random intervals from fifteen seconds to two minutes. The front cover 16 of jewelry piece 10, as illustrated in FIGS. 1 and 2, would be modified to include apertures for exposing each of the eight light emitters.

The embodiment of FIG. 10 may be modified by eliminating the phototransistor 34 of the astable multivibrator 40, as illustrated in FIG. 7, so the multivibrator 40 operates at a fixed freuency.

Another version of the FIG. 10 embodiment is depicted in FIG. 11. Two phototransistors 44 and 45, connected in series, serve as the input to gate 41. The output of gate 41 is connected directly to capacitor 61, thereby eliminating the counter/divider 50. The two phototransistors 44 and 45 would be supported on the jewelry piece 10 adjacent openings facing in different directions for receiving and comparing light intensities from the different directions. When the light intensities are significantly different, the output of gate 41 will go low and gate 63 will apply a positive pulse to the Johnson Counter 90 which in turn activates a light source L.

Figures 12, 13, 14, 15:
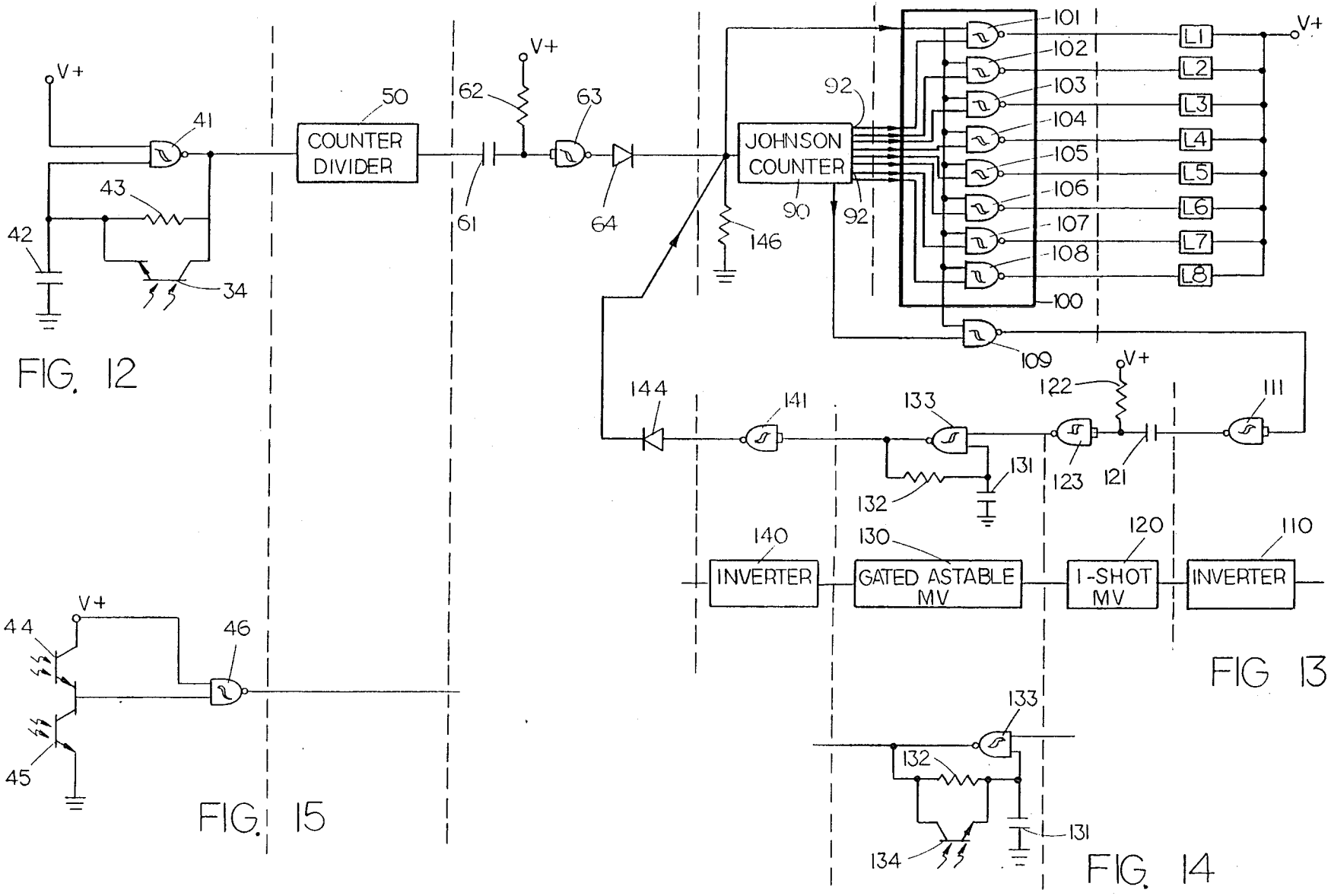
FIG. 12 is a further variation of the circuit of FIG. 10 including a feedback circuit between the switching means and input to the Johnson Counter.
FIG. 13 is a functional block diagram of the feedback circuit of FIG. 12.
FIG. 14 is a detail electrical schematic diagram of an alternate gated astable multivibrator for the feedback circuit of FIG. 12.
FIG. 15 is a detail electrical schematic diagram of an alternate source of random frequency pulses for the circuit of FIG. 12.

Another version of the FIG. 9 embodiment is illustrated in FIG. 12. This is the same circuit as illustrated in FIG. 10 except that a feedback circuit is inserted between the switching gates 100 and the input to the Johnson Counter 90. The feedback circuit is shown in functional block form in FIG. 13 as including inverter 110, one-shot multivibrator 120, gated astable multivibrator 130, an inverter 140 and a diode 144. Inverter 110 includes gate 111. One-shot multivibrator 120 includes capacitor 121, resistor 122 and gate 123, as shown in FIG. 12. Gated astable multivibrator 130 likewise includes a capacitor 131, resistor 132 and gate 133. Finally, inverter 140 includes the gate 141.

In operation, pulses from the one-shot multivibrator gate 63 travel through diode 64 and are applied across resistor 146 which is connected to the input of the Johnson Counter 90. The pulses advance the Johnson Counter's outputs 92 and flash the light sources L1–L8 in sequence. When a pulse is applied to switching gate 109, the feedback circuit is activated by the application of a negative pulse to the input of inverter gate 111.

The positive pulse from gate 111 is applied to capacitor 121 and resistor 122 which coact with gate 123 to apply a positive pulse of increased duration to the input of gate 133. Gate 133, capacitor 131 and resistor 132, constitute the gated astable multivibrator 130 which produces four cycles and then rests until another positive pulse is applied to its input.

The four cycles from the gated astable multivibrator 130 are applied to the Johnson Counter 90 by way of inverter gate 141 and diode 144. This causes light emitters L1–L4 to be pulsed in rapid succession. Random pulses from the one-shot multivibrator 60 will advance through light emitters L5–L8. The result is that four light emitters will be pulsed at random time intervals, followed by rapid sequential pulsing of the remaining four light emitters. The appearance is an occasional flicker of light followed by a rapid burst of four lights in sequence.

FIG. 14 displays a modification of the gated astable multivibrator 130 of FIG. 12 in which phototransistor 134 is added across resistor 132. As the intensity of the ambient light on phototransistor 134 varies, the number of cycles out of the gated astable multivibrator 130 will vary from one to four. The result will be an occasional random flicker of light followed by a rapid burst of from one to four lights in sequence.

The circuit of FIG. 12 may be modified by omitting the phototransistor 34 of astable multivibrator 40, as illustrated in FIG. 7. With this configuration, the pulsing of individual light sources would be at a fixed interval rather than random.

FIG. 15 displays another modification of the circuit of FIG. 12 in which the astable multivibrator gate 41 and the counter/divider 50 are replaced by two phototransistors 44 and 45 and a Schmitt Trigger Gate 46. This results in another form of random pulsing as determined by the relative light intensities falling on the two phototransistors 44 and 45.

Figures 16, 17:
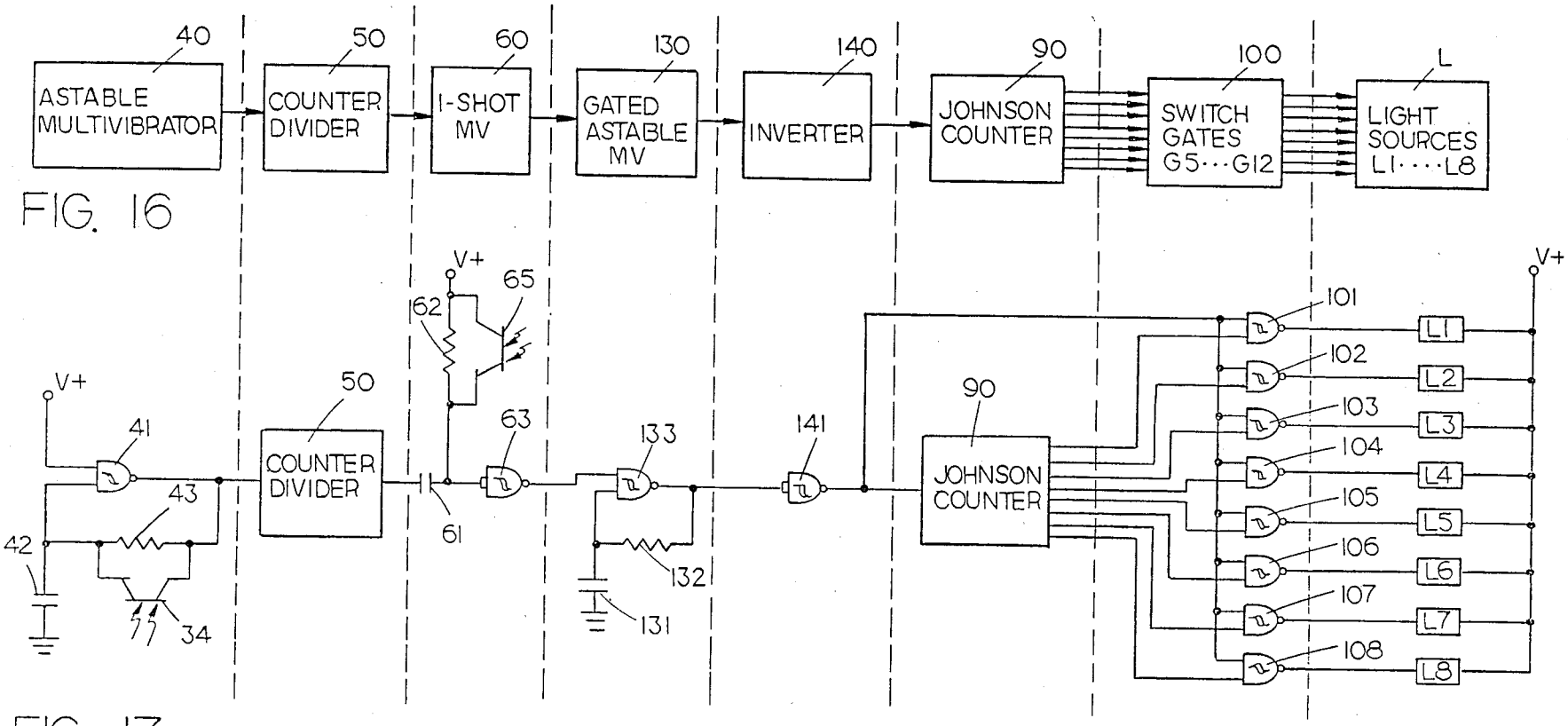
FIG. 16 is a functional block diagram of another circuit of the invention.
FIG. 17 is an electrical schematic circuit diagram of the circuit of FIG. 16.

A further embodiment of the invention is illustrated in FIG. 16 and 17. This embodiment is similar to the embodiment of FIGS. 9 and 10 except that a phototransistor 65 has been connected across resistor 62 of one-shot multivibrator 60 and gate 133 of gated astable multivibrator 130 and gate 141 of inverter 140 have been connected between the one-shot multivibrator gate 63 and the Johnson Counter 90. Phototransistor 65 coacts with resistor 62, capacitor 61 and gate 63 to apply a positive pulse of varying duration, depending on the ambient light intensity, to the input of the gated astable multivibrator gate 133. Gate 133 in conjunction with capacitor 131 and resistor 132, produces from one to four cycles which are applied to the input of the Johnson Counter 90 by way of inverter gate 141. The result is random bursts of from one to four lights.

Of course, the circuit of FIGS. 16 and 17 can likewise be modified to omit the phototransistor 65 so that the one-shot multivibrator 60 is of the form shown in FIG. 10. Also, phototransistor 34 of astable multivibrator 40 may be omitted as illustrated in FIG. 7. Finally, the astable multivibrator 40 may be modified as illustrated in FIG. 15 and the counter/divider 50 omitted to utilize the alternate circuit for random pulsing shown in FIG. 15.

In all of the above embodiments, the integrated circuits may be as follows: gates 74HC132; counter/divider 74HC4020; and Johnson Counter 74HC4022 or their electronic equivalents. All of the embodiments or combinations of the embodiments can be included in a single integrated circuit.

Thus there has been shown and described improved light-emitting electronic adornments which accomplish at least all of the stated objects.

I claim:

1. A light-emitting electronic adornment, comprising, a base item of personal adornment adapted to be worn by a person.

an electronically operated plurality of light-emission means on said base item, a counting means and a plurality of switching means electrically interposed between said counting means and said plurality of light emission means, an electrical circuit including source means for applying an electrical potential across said light-emission means thereby to emit light therefrom, frequency control means electrically connected in said circuit and operative to produce output pulses of controlled frequency, pulse width means electrically connected in said circuit and operative to produce output pulses of controlled width independent of said frequency control means, said light-emission means being electrically connected in said circuit so as to receive pulses from said source means as modified by said frequency control means and said pulse width means, thereby to simulate natural flickering light, and said frequency control means comprising two light sensors and a Schmitt Trigger Gate electrically connected to said source means for producing output pulses of random frequency wherein said light sensors are connected in series.

2. The adornment of claim 1 wherein said frequency control means comprises an astable multivibrator.

3. The adornment of claim 2 wherein said astable multivibrator includes a light sensor, said astable multivibrator being operative to vary the frequency of output pulses in response to changes in ambient light intensity sensed by said light sensor.

4. The adornment of claim 1 wherein said frequency control means comprises a multivibrator operative to produce pulses at a fixed frequency.

5. The adornment of claim 2 or 4 wherein said frequency control means further comprises a counter/divider electrically connected in said circuit to modify the output pulses of said multivibrator.

6. The adornment of claim 1 wherein said pulse width means comprises a one-shot multivibrator.

7. The adornment of claim 6 further comprising a phototransistor which coacts with said one-shot multivibrator to produce an output pulse of varying duration as a function of ambient light intensity.

8. The adornment of claim 1 wherein said counting means is a Johnson Counter having a "clock" input and said switching means has a plurality of switching gates, electrically connected in said circuit such that pulses from said source, as modified by said frequency control means and said pulse width means are applied to the "clock" input of said Johnson Counter and to an enable input of said switching gates wherein each pulse at the input of the Johnson Counter applies a pulse to one of the switching gates and thereby activates one of the light emitters.

9. The adornment of claim 8 further comprising a feedback circuit electrically interposed between said switching gates and the input to the Johnson Counter, said feedback circuit being operative to occasionally direct a plurality of pulses in rapid succession to the Johnson Counter for a rapid burst of light from a plurality of light emission means.

10. The adornment of claim 9 wherein said feedback circuit includes a one-shot multivibrator and a gated astable multivibrator.

11. The adornment of claim 10 wherein said gated astable multivibrator includes a phototransistor operative to vary the number of said plurality of pulses as a function of ambient light intensity.

12. The adornment of claim 8 wherein said frequency control means comprises an astable multivibrator operative to produce an output signal of randomly pulsed frequency and a counter/divider electrically connected in said circuit to modify the output signal of said astable multivibrator, said pulse width means comprising a one-shot multivibrator.

13. The adornment of claim 12 further comprising a gated astable multivibrator and inverter electrically interposed in said electrical circuit between said one-shot multivibrator and Johnson Counter.

* * * * *